US007591215B2

(12) United States Patent
Galba

(10) Patent No.: US 7,591,215 B2
(45) Date of Patent: Sep. 22, 2009

(54) VARIABLE DISPLACEMENT HYDRAULIC MACHINE HAVING A SWASH PLATE

(75) Inventor: Vladimir Galba, Nova Dubnica (SK)

(73) Assignee: Poclain Hydraulics, Verberie Cedex (FR)

( * ) Notice: Subject to any disclaimer, the term of this patent is extended or adjusted under 35 U.S.C. 154(b) by 165 days.

(21) Appl. No.: 11/269,971

(22) Filed: Nov. 9, 2005

(65) Prior Publication Data

US 2007/0089600 A1 Apr. 26, 2007

(30) Foreign Application Priority Data

Oct. 26, 2005 (EP) ..... 05292265

(51) Int. Cl.
*F01B 3/02* (2006.01)

(52) U.S. Cl. ..... 92/12.2; 92/57

(58) Field of Classification Search ..... 92/12.2, 92/57; 91/504–506; 74/839
See application file for complete search history.

(56) References Cited

U.S. PATENT DOCUMENTS 2,737,895 A * 3/1956 Ferris ..... 92/12.2
2,871,798 A * 2/1959 Thoma ..... 91/489
3,862,588 A 1/1975 Bahrle et al.
4,710,107 A 12/1987 Kanies
4,934,253 A * 6/1990 Berthold et al. ..... 91/506
5,390,584 A 2/1995 Fritz et al.
5,495,712 A 3/1996 Yano et al.

FOREIGN PATENT DOCUMENTS

| | | |
|---|---|---|
| EP | 0 608 144 | 7/1994 |
| EP | 1 519 042 | 3/2005 |
| JP | 59113274 | 6/1984 |

* cited by examiner

*Primary Examiner*—F. Daniel Lopez
(74) *Attorney, Agent, or Firm*—Ladas & Parry LLP

(57) ABSTRACT

A hydraulic machine having a housing, a cylinder block located in the housing and having axial pistons slidably movable in cylinders, a shaft rotationally connected to the cylinder block, and a swash plate in load engagement with the pistons of the cylinder block. The swash plate is pivotally mounted in the housing by at least one bearing, such that said swash plate is pivotally adjustable about a kinematic axis to alter a hydraulic displacement of the pistons in the cylinder block. The thrust pistons are located between the swash plate and the housing so as to urge the swash plate toward the cylinder block.

22 Claims, 7 Drawing Sheets

VARIABLE DISPLACEMENT HYDRAULIC MACHINE HAVING A SWASH PLATE

FIELD OF THE INVENTION

The present invention relates to a hydraulic machine. In particular, the present invention relates to an axial piston hydraulic machine having variable displacement.

BACKGROUND OF THE INVENTION

Radial bearing of the swash plate in known hydraulic machines is achieved using a number of rolling-contact (anti-friction) bearings. These bearings are mounted in two basic arrangements. The first arrangement comprises complete rolling bearings (for example roller bearings in serial arrangement). However, complete rolling bearings usually require larger built-in space, which has an unfavourable effect on the outer dimensions of the axial piston machine and on its total weight. U.S. Pat. No. 5,495,712 for example discloses a variable displacement type hydraulic system in which the swash plate is mounted by side projections upon respective roller bearings fixed inside the housing.

The second arrangement utilises partial roller bearings with a synchronizing mechanism for angular synchronization of the position of the retaining cage of the bearings relative to the swash plate. However, the partial rolling bearings are more expensive due to the arrangement of the retaining system and synchronizing mechanism. U.S. Pat. No. 5,390,584 discloses a follow up mechanism for a swash plate bearing. The swash plate is mounted on rollers in a bearing cage permitting the swash plate to tilt. In addition, angular movement of the first and second ends of a link moves the bearing cage to maintain the proper timing of the bearing cages.

A further disadvantage of both above-mentioned arrangements is that vibrations are transmitted through the housing towards the surroundings as a redundant noise.

A further known arrangement for radial bearing of a swash plate comprises a plurality of partial radial sliding bearings. These bearings are used either with partial hydrostatic balance or without hydrostatic balance. The disadvantage of both arrangements concerns friction in the bearing in some operating modes of the axial piston machine. This can be unsuitable with respect to safety in applications of hydrostatic drives for mobile machines. U.S. Pat. No. 4,710,107 relates to swashblock lubrication in axial piston fluid displacement devices. The rear of the swashblock 26 has a pair of arcuate bearing surfaces, which are supported by the device.

The friction can also have a negative effect on the control characteristics of the piston machine. Especially if it is a pump for hydrostatic drive of mobile machines, because the quality of some control properties of the hydrostatic drive may decrease.

The sliding support of a swash plate has better dampening properties. However, pulsating loading from pistons which is transmitted through the swash plate into the housing, has the same value as with rolling bearings, so that this loading is responsible for vibrations of the housing and for noise of the axial piston machine.

It is an object of the present invention to provide a variable displacement hydraulic machine that provides reduced vibrations and/or reduced noise and/or reduced size with respect to prior art hydraulic machines, or at least to provide a useful alternative.

SUMMARY OF THE INVENTION

The present invention provides a hydraulic machine comprising: a housing, a cylinder block located in the housing and having pistons slidably movable in cylinders, a shaft rotationally connected to the cylinder block; and a swash plate in load engagement with the pistons of the cylinder block, the swash plate being pivotally mounted in the housing by at least one bearing, such that said swash plate is pivotally adjustable about a kinematic axis to alter a hydraulic displacement of the pistons in the cylinder block, wherein thrust pistons are located between the swash plate and the housing so as to urge the swash plate toward the cylinder block.

Preferably the thrust piston is adapted to be in fluid communication with one of first and second main ducts of the hydraulic machine. Preferably said communication can be through the piston cylinder.

A further preferable feature is that the pivotal mounting of the swash plate in the housing comprises two swinging bearings coaxial with said kinematic axis.

The thrust piston is preferably housed in a cylindrical recess in one of said housing member or said swash plate.

The hydraulic machine preferably comprises first and second groups of thrust pistons located in cylindrical recesses in the swash plate. Said recesses of the thrust pistons of said first group are hydraulically connected to each other and permanently hydraulically connected to one of a first and a second main ducts of the machine, which is at the higher pressure.

Preferably, a first cylindrical recess for a thrust piston of the second group of thrust pistons is located on a first or right side of the machine defined by a plane perpendicular to the kinematic axis and passing through the rotation axis, and said first cylindrical recess is adapted to be hydraulically connected to a first main duct of the machine, and a second cylindrical recess for a thrust piston of the second group and located on the other (second or left) side of the machine defined by said plane is adapted to be hydraulically connected to a second main duct of the machine.

Preferably, said first cylindrical recess of the second group is hydraulically connected to said first main duct via a first pressure channel in the swash plate, which is in communication with a piston cylinder when said piston cylinder is in communication with said first main duct, and said second cylindrical recess of the second group is hydraulically connected to said second main duct via a second pressure channel in the swash plate, which is in communication with a piston cylinder when said piston cylinder is in communication with said second main duct.

Preferably, the housing has first and second arcuate bearing surfaces formed thereon, respectively cooperating with the right and left thrust pistons located in cylindrical recesses of first and second corresponding arcuate surfaces of the swash plate.

Preferably, a pre-stressed spring is mounted between the thrust piston and the swash plate. Preferably, a pre-stressed spring is located in each of said cylindrical recesses.

The hydraulic machine preferably comprises at least a right thrust piston of each of the first and second groups located on one side of a plane which is perpendicular to the kinematic axis and passes through the rotation axis of the cylinder block, and at least a left thrust piston of each of the first and second groups located on the other side of said plane.

The thrust pistons are preferably abutted against first and second arcuate bearing surfaces by a partly cylindrical bearing surface formed in each thrust piston. Said partly cylindrical surface has the same profile as the cylindrical arcuate bearing surface of the housing.

The centres of said first and second arcuate bearing surfaces can be coaxial with said kinematic axis. Alternatively, the first and second arcuate bearing surfaces can be eccentric with respect to said kinematic axis.

The arrangement of the axial piston machine according to the invention substantially eliminates the transmission of pulsating forces generated by the pistons of the cylinder block and transmitted through the swash plate into the housing.

In addition, the vibrations and deformation created by the pulsating forces are also eliminated. Consequently, noise of the axial piston machine is reduced. Compared to the swash plate bearings of the prior art with bearing balancing and loading forces from the axial pistons, which are generally equal, the bearing arrangement for the swash plate of the hydraulic machine of the invention also reduces bending stress on the swash plate because the balancing force is greater than the loading forces on the swash plate, and consequently the deformation of the swash plate is reduced. This is favourable with respect to the dimensioning and the selection of material for the swash plate.

A further advantage concerns the reduction of some dimensions of the swash plate and consequently the axial built-in space and weight are reduced, since the bearing on which the swash plate is pivotally mounted in the housing can be a partial bearing, considering that the swash plate is also supported with thrust pistons.

On account of the eccentric arrangement of the cylindrical bearing surfaces, the forces required for the control of the angular position of the swash plate are reduced. This has a favourable influence on the dimensions of the servo-cylinders (not shown in the drawings, they serve the function of inclining the swash plate) and/or on the level of their control pressure, which can be decreased.

Consequently, outer dimensions and weight of the axial piston machine, as well as the power of the auxiliary pump, which supplies these servo-cylinders, can also be decreased. Consequently, without other modifications, input torque of the axial piston machine can be also reduced. This causes effective restriction of the overload of the driving engine of this machine when working as a pump.

Further any type of control of the displacement such as manual, hydraulic or electrohydraulic control can be used. For example it is possible to use a manual control, which permits the control of the torque, without the need of servo-valves and servo-cylinders, even for higher values of displacement and applications with higher working pressure compared to the machine of the prior art.

Despite the elimination of a need for rolling bearings for the swash plate, the friction is at a level, which advantageously provides a low hysteresis of the control forces, which define the characteristics of the pump. Moreover it is possible to modify the behaviour of the control forces, so that it provides the safety of zero displacement at start-up, which is an important safety characteristic in applications for mobile hydrostatic transmissions.

Conventionally axial piston machines have an odd number of pistons and the forces transmitted into the swash plate vary as a function of the number of pistons at high pressure so that their transmission into the housing generates vibrations and noise. In an arrangement according to the present invention, according to which the cylindrical recesses for the first group of thrust pistons are hydraulically connected by a valve device to one of two main ducts of the machine, which is at the higher pressure, the forces generated by the thrust pistons of the first group are proportional to the high pressure and do not depend on the number of high pressure pistons and the forces transmitted into the housing through both swinging bearings are substantially constant when pressures are constant in the main ducts. Consequently redundant vibrations and noise are avoided.

The present invention substantially eliminates noise and vibrations, which exist in prior art devices (typically in the case of swash plate type axial piston machine with an odd number of pistons).

Moreover, because the pre-stressed springs between the thrust pistons and the recesses continuously urge the swash plate towards the swinging bearings, the swash plate is maintained in a position during transport without requiring a special hold-on device.

DETAILED DESCRIPTION OF THE PREFERRED EMBODIMENTS

The invention will now be described by way of example with reference to the accompanying drawings.

Figure 1:
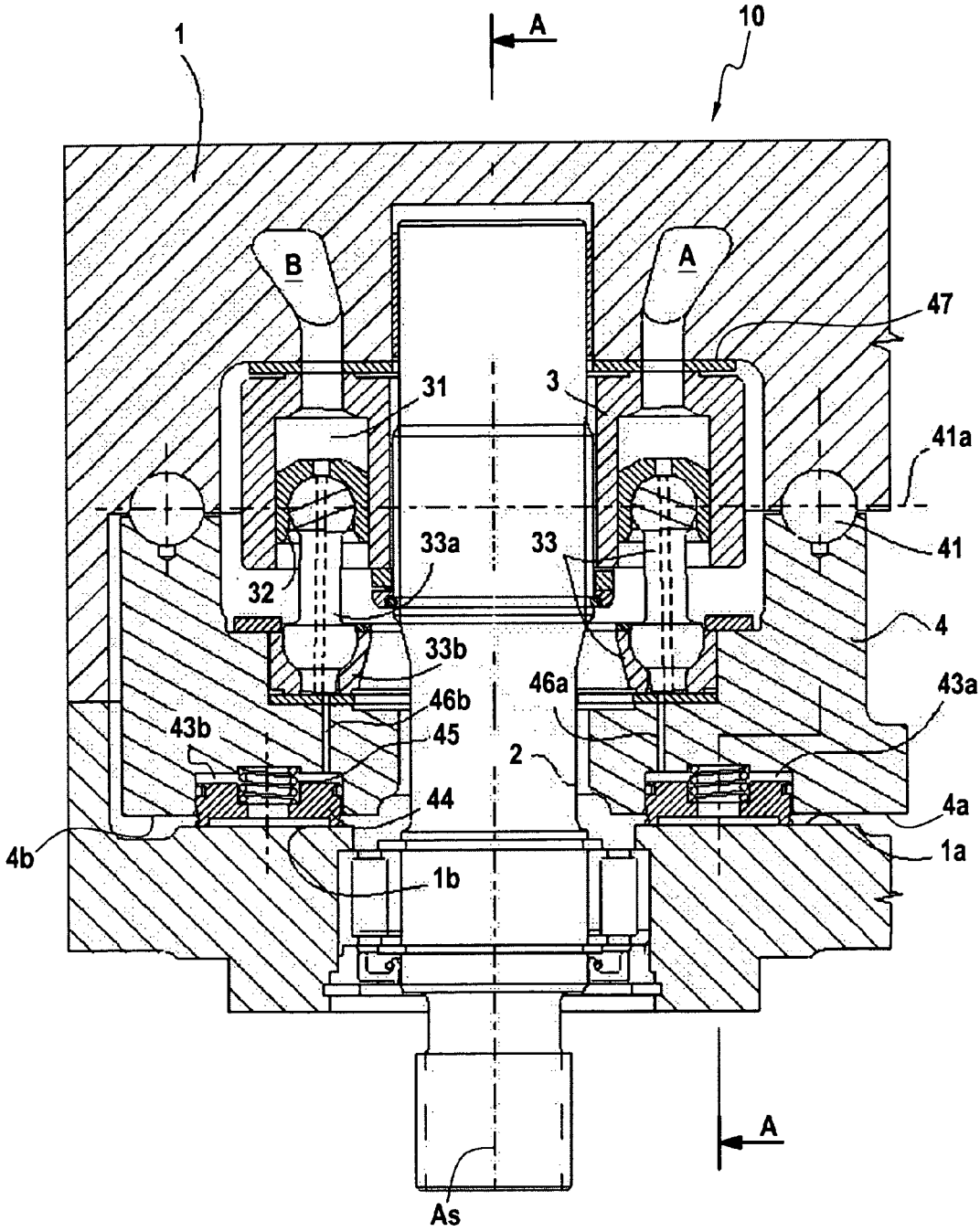
FIG. 1 is a longitudinal cross-sectional view of a hydraulic machine of the present invention through a plane defined by the axis of the shaft and by the kinematic axis of the swash plate.

FIG. 1 shows a hydraulic machine in the form of an axial piston pump unit indicated by the reference numeral 10 comprising a housing member 1. The housing member 1 encases a cylinder block 3 driven by a shaft 2, and a swash plate 4, so as to form a hydraulic unit 10.

The shaft 2, which is connectable to an internal combustion engine (not shown) or other such power source, is rotationally mounted on bearings (not labelled) inside the housing member 1.

The cylinder block 3 advantageously has an odd number of cylinders 31 machined therein. Each cylinder 31 is axially parallel to the axis of rotation of the shaft 2.

Each cylinder 31 houses a piston 32, which is pivotally connected to a piston rod 33*a* by means of a spherical joint. The piston rod 33*a* is pivotally connected at its other end to a sliding plate 33*b*. The piston rods 33*a* and sliding plate 33*b* together form a transmission device 33 that transmits an axial force from the piston 32 to the swash plate 4. The transmission device can be for example also slippers, that is, elements that are connected to the pistons via respective spherical joints at one end, and that are linked together at the other end by a sliding member, sliding on the swash plate.

Figure 2:
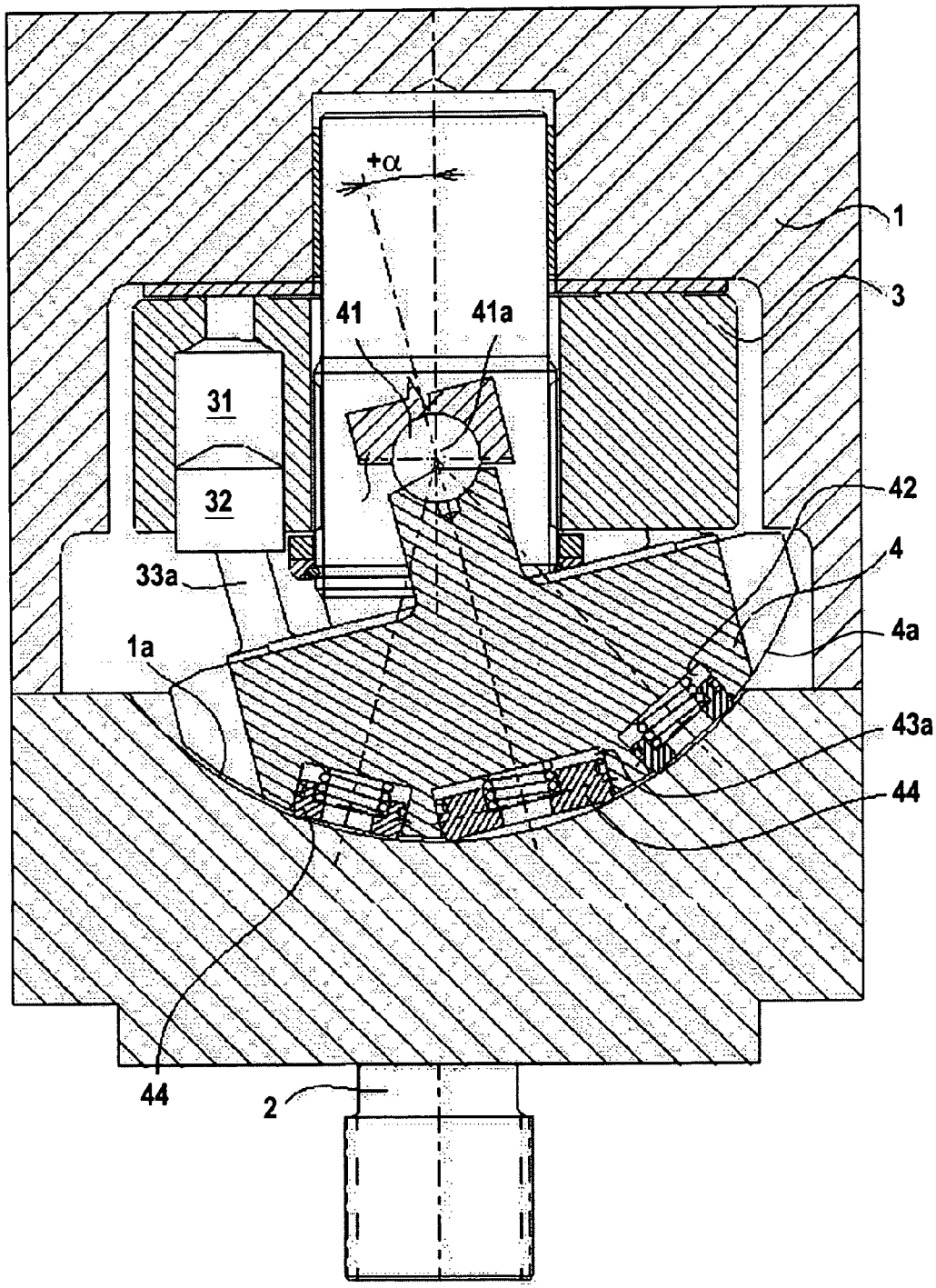
FIG. 2 is a cross-sectional view taken through A-A from FIG. 1.

The sliding plate 33*b* is adapted to rotate relative to the swash plate 4 by means of a thrust plate. The thrust plate is immovably mounted on the swash plate 4. As seen in FIGS. 1 and 2, the swash plate 4 is mounted in the housing on two swinging bearings 41, positioned one on either side of the shaft 2 More precisely, it is positioned on either side of a plane, perpendicular to the kinematic axis of tilting 41*a* of the swash plate 4, and comprising the axis of the shaft 2. The kinematic axis of tilting 41*a* is perpendicular to the axis As of the shaft 2, which it intersects.

As shown in FIG. 1, the swinging bearings 41 are spherical bearings with their centers located on the kinematic axis of tilting 41*a* of the swash plate 4. In an embodiment not shown in the drawings the bearing of the swash plate 4 in the housing can be achieved using any other bearing, which permits tilting of the swash plate in 2 dimensions.

A valve plate 47, as seen in FIG. 1 is located between the cylinder block 3 and the housing member 1 at the end of the cylinder block 3 which is furthest from the swash plate 4. The valve plate 47 has first and second openings formed therein, respectively located on a first (right) and second (left) opposing sides of the machine defined by a plane perpendicular to the kinematic axis 41 a and passing through the rotation axis As. Each one of said first and second openings is hydraulically connected with one of the two main input and output pressure ducts A, B of the pump unit 10. The input and output pressure ducts A, B are in fluid communication through the openings of the valve plate 47 with the cylinders 31. The input and output pressure ducts A, B of the device are also connectable to a hydraulic motor or other such hydraulic device, not shown in the drawings.

The swash plate 4 is received in the housing by corresponding first and second arcuate bearing surfaces 1*a*, 1*b*, formed on an inner curved arcuate surface of the housing, and being respectively located on a first (right) and second (left) opposing sides of the machine as defined above. As seen in FIGS. 1 and 2, the swash plate has a first and second arcuate surfaces 4*a* and 4*b*, which respectively substantially correspond in shape to the first and second bearing surfaces 1*a*, 1*b*. The first and second arcuate surfaces 4*a*, 4*b* of the swash plate 4 are respectively in correspondence with the first and second openings of the valve plate.

Figure 4:
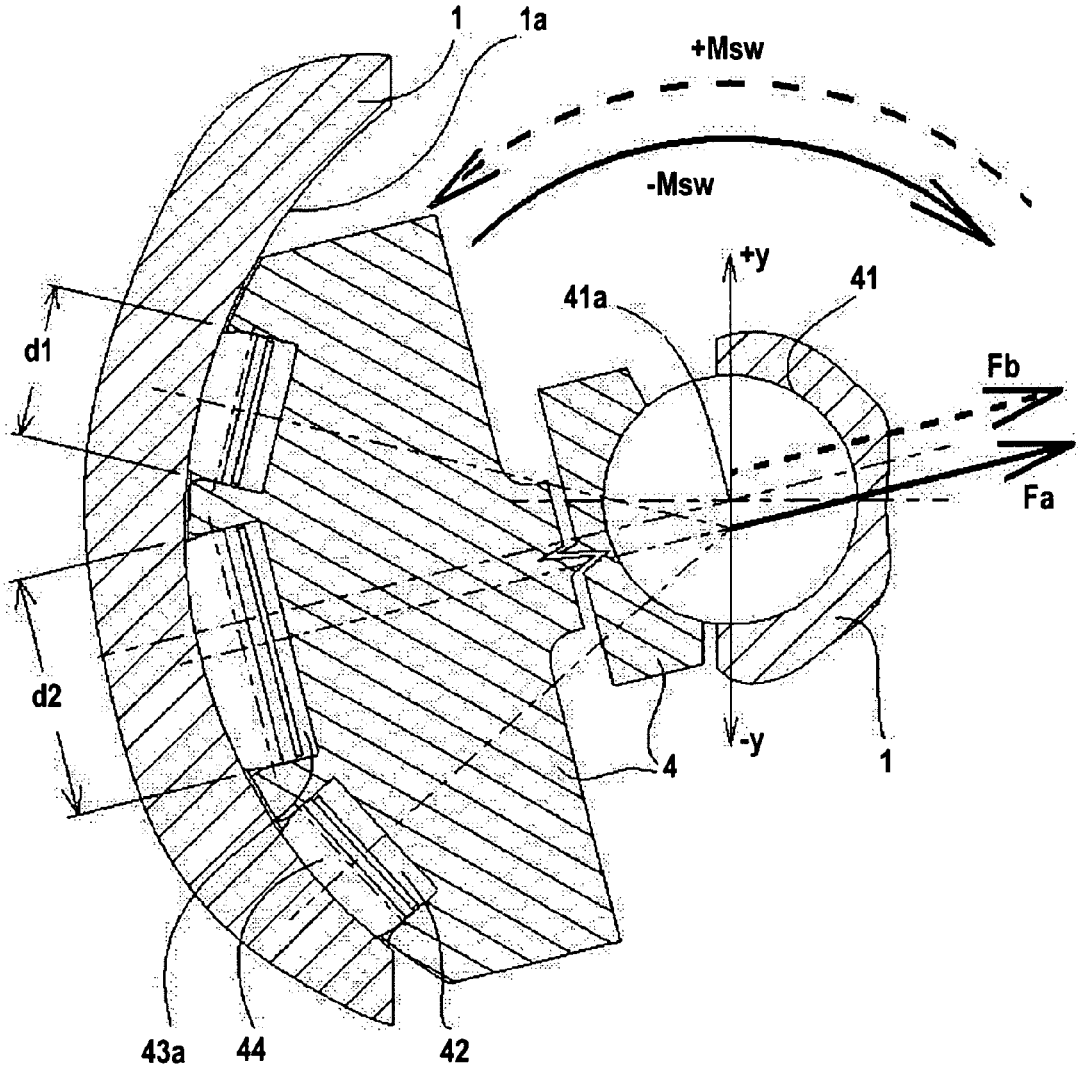
FIG. 4 is a partial cross-sectional view of the support of the swash plate from FIG. 2, wherein cylindrical control surfaces are off centred in the direction (±Y)
Figure 6:
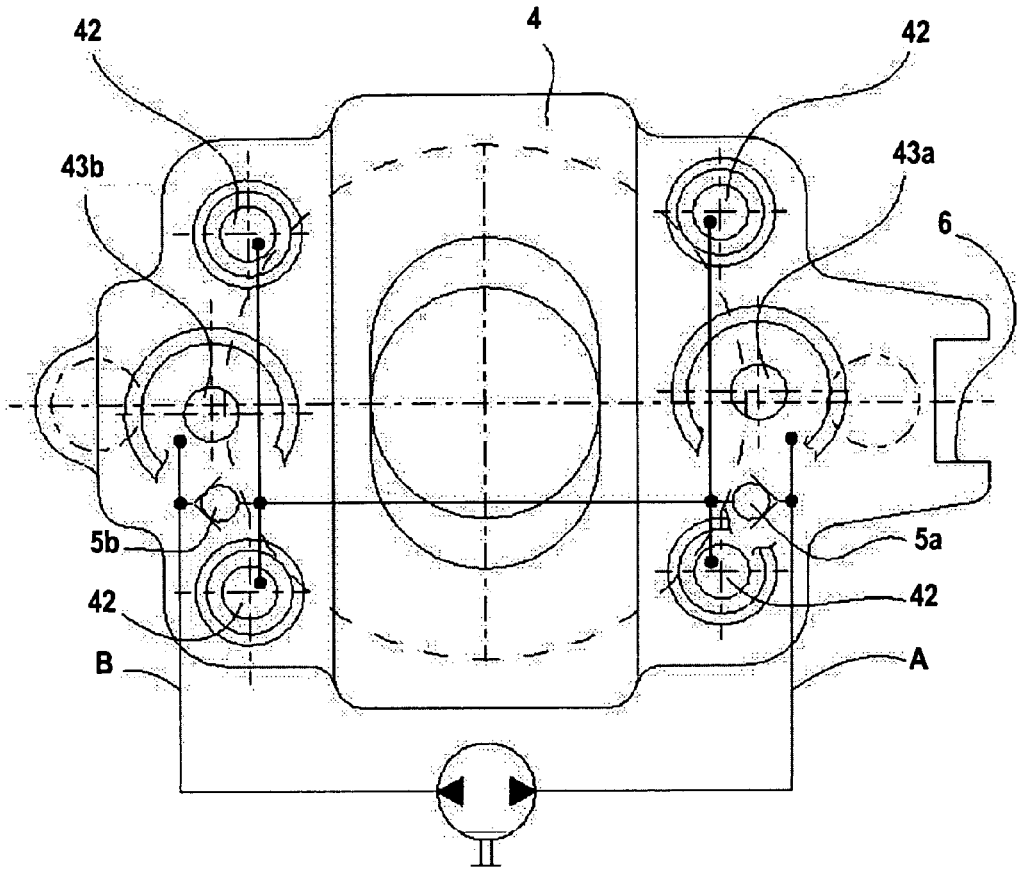
FIG. 6 is a bottom view of the swash plate showing the cylindrical recesses with a schematic illustration of their hydraulic interconnection according to the invention.

Referring to FIGS. 4 and 6, the swash plate 4 includes a first group of cylindrical recesses 42, and a second group of cylindrical recesses 43*a*, 43*b*, formed in the arcuate surfaces 4*a*, 4*b*. The first group of cylindrical recesses 42 comprises 4 recesses, such that there are two recesses 42 on each surface 4*a*, 4*b*. The second group of cylindrical recesses 43*a*, 43*b* comprises one cylindrical recess 43*a*, 43*b* located respectively on each arcuate surface 4*a*, 4*b*.

Each cylindrical recess of the first group 42 has a diameter d1. The cylindrical recesses 43*a*, 43*b* of the second group each have a diameter d2. In the embodiment shown in the drawings, the diameter d2 is larger than d1. On each arcuate surface 4*a*, 4*b* a recess 43*a*, 43*b* of the second group is located between two recesses 42 of the first group. Other arrangements, numbers and relative diameters of recesses are possible.

Figure 3:
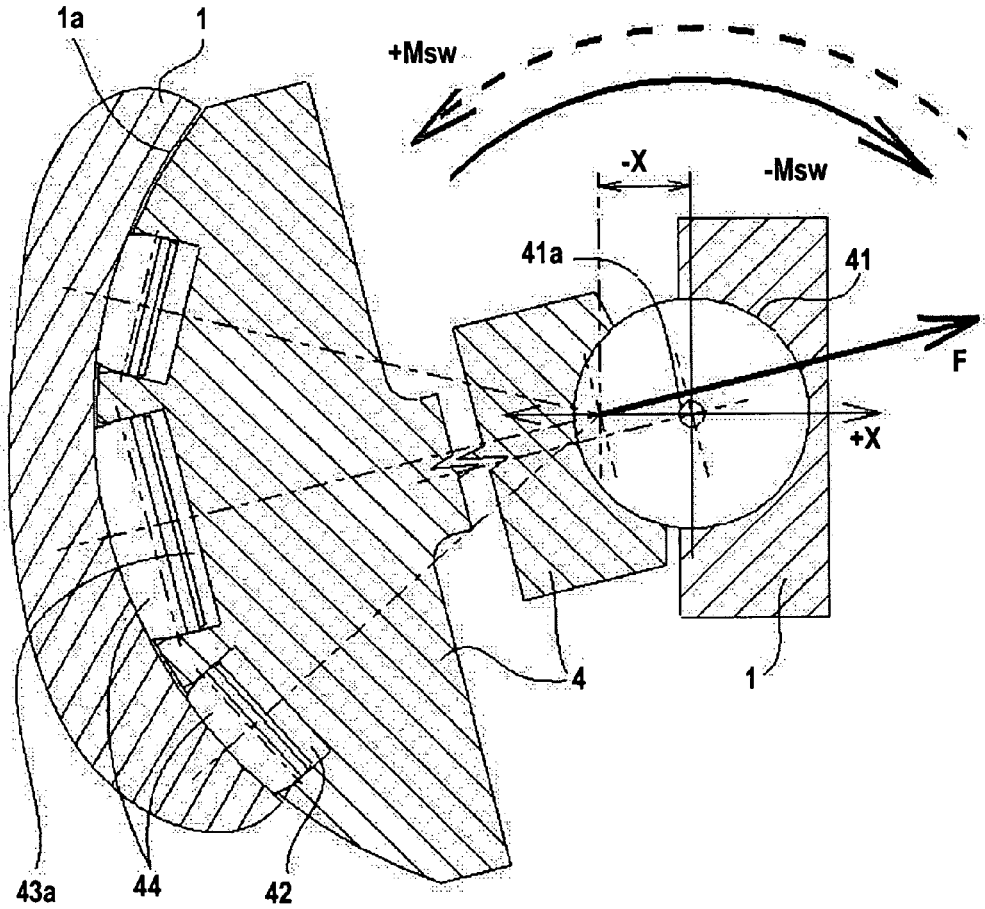
FIG. 3 is a partial cross-sectional view of the support for the swash plate from FIG. 2, wherein the cylindrical control surfaces are off centred in the direction (−X)
Figure 7:
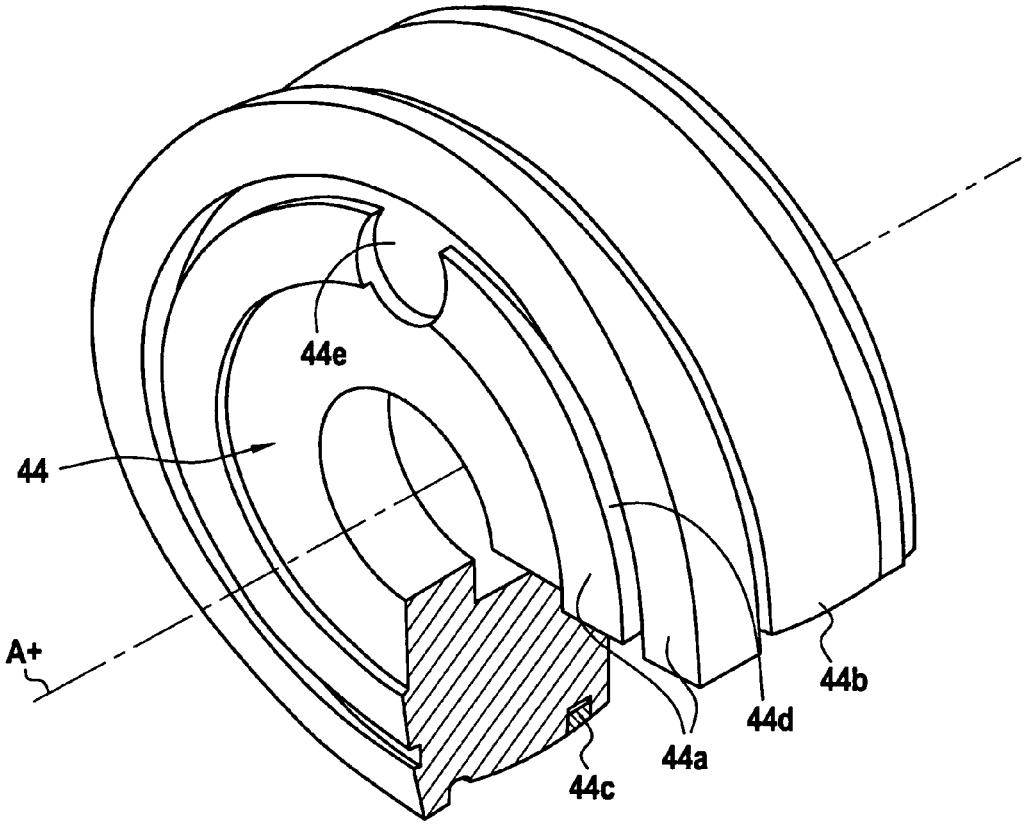
FIG. 7 is a partially sectioned perspective view of a thrust piston according to the invention.

As seen in FIGS. 3, 4 and best seen in FIG. 7, a thrust piston 44 is positioned in each of the cylindrical recesses 42, 43*a*, and 43*b*. Each thrust piston 44 has a spherical side surface 44*b* formed thereon for contacting the surface of the cylindrical recess 42, 43*a*, 43*b*. A pre-stressed spring 45 is located in each cylindrical recess 42, 43*a*, 43*b* between the swash plate 4 and the thrust piston 44.

Each thrust piston 44 is axially abutted by a cylindrical bearing surface 44*a* on one of the first and second arcuate bearing surfaces 1*a*, 1*b*, which are immovable with respect to the housing 1. As shown in FIG. 2, the arcuate bearing surfaces 1*a*, 1*b* are formed directly in the housing 1. The cylindrical bearing surfaces of the thrust pistons have a profile that corresponds to the arcuate cylindrical bearing surface 1*a*, 1*b*.

Each thrust piston 44 has a side surface 44*b*, which is formed having a profile, which forms a portion of a sphere. The spherical portion 44*b* permits the thrust piston 44 to be angularly tilted inside the cylindrical recess 42, 43*a*, 43*b*, such that the axis of the thrust piston 44 can be angularly misaligned relative to the axis of the cylindrical recess 42, 43*a*, 43*b*, whilst maintaining a hydrodynamic seal.

The end surface of the thrust piston 44, which is positionable on the relevant arcuate bearing surface 1*a*, 1*b* is formed having a partially cylindrical surface 44*a*, as created by the intersection of a cylinder with the thrust piston 44, whereby the axis of symmetry of the cylinder is perpendicular to and intersects with the axis At of the thrust piston, therefore the shape of the cylindrical surface 44*a* is adapted to correspond to the shape of the arcuate surface 1*a*, 1*b*, so as to provide evenly distributed contact.

The partially cylindrical surface 44*a* has a groove 44*d* formed therein, defining an annular recess. A communication passage formed by a substantially circular recess 44*e* is located in the partially cylindrical surface 44*a* and enables fluid circulation between the centre of the thrust piston 44 and the groove 44*d*.

A first cylindrical recess 43*a* of the second group of cylindrical recesses 43*a*, 43*b* is hydraulically connected to the first main pressure duct A of the axial piston machine 10 by means of a first pressure channel 46*a*. As shown in FIG. 1, the first pressure channel 46*a* is formed by a hollow passage in a piston cylinder 31, in the corresponding piston 32, through the piston rods 33*a*, in the sliding plate and in the thrust plate whereby the passage extends through the swash plate 4, into the base surface of the cylindrical recess 43*a*. The second cylindrical recess 43*b* is similarly hydraulically connected to the second main pressure duct B by means of a second pressure channel 46*b*. There is a through hole as seen in FIG. 1 formed in the centre of each thrust piston 44, which provides a hydraulic fluid flow path from the base surface of the cylindrical recess to the housing.

Alternatively, in an embodiment not shown in the drawings, the first and second pressure channels 46*a*, 46*b* can be formed in the housing 1, such that each pressure channels 46*a*, 46*b* is connected to one of the cylindrical recesses 43*a*, 43*b*, through a hole in one of the arcuate bearing surfaces 1*a*, 1*b*. In this arrangement the pressure channel 46*a*, 46*b* passes through the housing 1 and the opposite end of the pressure channels 46*a*, 46*b* is connected to a portion of the main pressure ducts A, B.

Figure 5:
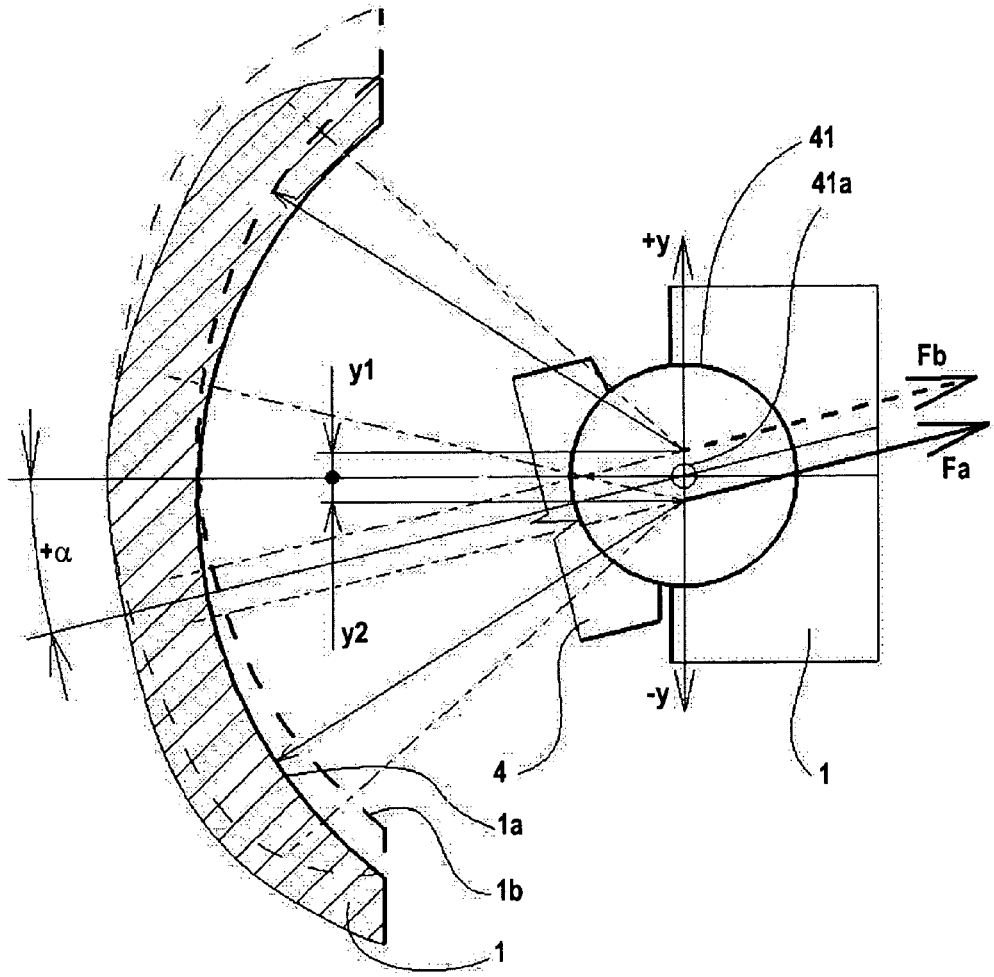
FIG. 5 is a partial cross-sectional view of the support of the swash plate from FIG. 4, wherein the cylindrical control surfaces are off centred in the direction (±Y)

As seen in FIG. 2, the first bearing surface 1*a* is arcuate, and has an axis of rotation, which is coaxial with the kinematic axis of tilting 41*a*. The second arcuate bearing surface 1*b* is determined the same way. Alternatively, in the embodiment shown in FIGS. 3-5, the arcuate bearing surfaces can be eccentric with respect to the kinematic axis of tilting as seen in a plane, which is perpendicular to the kinematic axis 41*a*. Further to the advantage of noise reduction due to the influence of the thrust pistons, the eccentricity of the arcuate bearing surfaces in the second embodiment adds the advantage of decreasing requirements on servo-cylinder dimensioning and/or control pressure. The eccentricity on that plane can be in the X direction (direction parallel to the axis of the shaft 2) or the Y direction (perpendicular to the axis of the shaft 2). A positive X value indicates the centre of the arcuate bearing surface 1*a*, 1*b* to be on the side of the kinematic axis 41*a* closer to the cylinder block 3. Each arcuate bearing surface 1*a*, 1*b* of the pump unit 10 can have a different centre point, having a given value which is plus or minus in both the X and Y directions.

It will be explained further that advantageously the eccentricities in direction X, for both arcuate bearing surfaces 1*a* and 1*b* have generally the same magnitude and the same direction (+/+ or −/−) and that advantageously the eccentricities in direction Y, perpendicular to the axis of the shaft, also have generally the same magnitude but opposite directions (+/− or −/+).

As is schematically shown in FIG. 6, all of the cylindrical recesses 42 of the first group of cylindrical recesses 42 are interconnected by valve devices 5*a*, 5*b* to the main pressure duct A or B, which has the higher pressure level. This valve device 5*a*, 5*b* can consists of two check valves, or of a well-known shuttle valve or of a selector, which selects the higher pressure.

The operation of the device will now be described. When the axial piston machine 10 works as a pump, for example in a hydrostatic transmission, and is loaded from a hydraulic motor, considering the first main pressure duct A and the corresponding group of piston cylinders 31 will be at higher pressure than the second main pressure duct B, consequently the first group of cylindrical recesses 42 will be connected through the valve device 5*a*, 5*b* to the first main pressure duct A.

Then the first group of cylindrical recesses 42 and the corresponding second cylindrical recess 43*a* are connected to the main duct at the higher pressure which is the output working pressure when the hydraulic machine is working as a pump, and the second cylindrical recess 43*b* is connected to the lower pressure duct B which is at the input pressure when the machine is working as a pump, for example, by a charge valve.

Each thrust pistons 44 as a result of the hydraulic pressure in the cylindrical recesses 42, 43*a*, 43*b*, generates a force, which acts on the swash plate 4, in a direction opposite to the forces generated by the pistons 32. By suitable dimensioning of all related parts of the axial piston machine 10, the forces acting on both swinging bearings 41 will have the same value and their directions will be from the swash plate 4 towards the cylinder block 3.

The forces applied to both swinging bearings 41 are subsequently transmitted to the housing 1. The forces have a pulsating behavior and the same amplitudes of their variable components. The transmission of the pulsating forces occurs over a short distance between the ball bearings 41 and the arcuate bearing surfaces 1*a*, 1*b*, which is a characteristic of a great stiffness. This arrangement tends to eliminate vibrations and noise.

For a given value of the high pressure the forces that are transmitted from the thrust pistons 44 into the housing 1 are constant and dependent specifically mainly on the higher pressure in the first or second main pressure duct A, B and not on the number of pistons. These forces have a favourable influence on vibrations.

The consequence is the substantial elimination of the transmission of the pulsating axial forces from the pistons 32 between front and rear parts of the housing 1 and this reduces the noise of the piston machine 10. Further favourable influences of this arrangement are a decrease in bending stress generated by the pistons 32 on the swash plate 4 and a decrease of reactions in the bearing of the swash plate 4 because bearing balancing forces are higher than the loading forces generated by the pistons.

Accordingly, the loading of the swash plate 4 is lower and consequently it is possible to reduce the characteristic dimensions related to this loading and/or to reduce the deformations from the loading of the pistons 32.

As explained a short distance between the opposing forces generated by the pistons 32 and the thrust pistons 44 has a favourable influence upon reducing the forces applied to the swash plate 4. The shorter the distance, the smaller the forces. By a suitable dimensioning of the arrangement of the swinging bearings 41 and of the arcuate bearing surfaces 1*a*, 1*b* of the swash plate 4 of the axial piston machine 10, it is possible to ensure that forces acting on the swinging bearings 41 always have the same values and the same direction in the whole range of working conditions, while their maximum value is limited. This permits favourable dimensioning of the swinging bearings 41.

If the axes of the arcs of the first arcuate bearing surface 1*a* and the second arcuate bearing surface 1*b* are coaxial with the kinematic axis of tilting 41*a*, then the resultant of the forces from the thrust pistons 44 intersects the kinematic axis of tilting 41 and has no influence on the moments of the forces from the pistons 32 acting on the swash plate 4.

If the axes are eccentric, a further advantage is that the force required for the control of the swash plate 4 can be reduced. Further it becomes possible to meet some specific requirements of a given application, for example, for the control and the reduction of input torque of a pump.

Generally, when the piston machine 10 works as a pump, the moment (−Msw shown in FIGS. 3-4) of the axial forces from the pistons 32 acting on the swash plate 4 has a tendency to tilt the swash plate 4 from its adjusted angular orientation ($\alpha$) toward a zero value of this angle, whereby ($\alpha$) is the angle of tilt of the swash plate relative to the axis of the shaft 2. If the piston machine 10 works as a motor or as a pump in the braking mode, this moment (+Msw shown on FIGS. 3-4) acts in the opposite direction and tends to tilt the swash plate 4 towards the maximum value of the inclination of angle ($\alpha$).

Referring to FIG. 3, when either the first arcuate bearing surface 1*a* or the second arcuate bearing surface 1*b* is created eccentric with respect to the kinematic axis of tilting 41*a*, then the resultant of force F from the thrust pistons 44 will intersect the axis of the corresponding cylindrical surface. This resultant force F will create with respect to the kinematic axis of tilting 41*a* a moment $+M_F$ or $-M_F$, which will have an influence on the swash plate behavior and accordingly, on the swash plate control.

Referring to FIG. 3, for the eccentricity of the type ±X, in a direction of the shaft 2 axis, the resultant moment $M_F$ will be proportional to the value $\pm X.\sin\alpha$. Since the same working characteristics of the machine are usually required for inclination angle $\pm\alpha$, it is important that the X-eccentricity of arcuate bearing surfaces 1*a* and 1*b* have the same sign and the same value.

For example, in a pump mode, the resulting moment Mr, which is the sum of Msw and MF, will tend to tilt the swash plate 4 towards the zero angular position with a higher moment if eccentricity is −X, regardless of the direction of the shaft rotation because Msw and MF have the same sign or direction (as shown on Table 1).

For the eccentricity of the type ±Y (as seen in FIG. 4) in a direction perpendicular to the axis of the shaft 2, the balancing moments ($M_{Fa}$ on the side of arcuate bearing surface 1*a*, $M_{Fb}$ on the side of arcuate bearing surface 1*b*) from the thrust pistons 44 are proportional to the value $Y*\cos\alpha$, so that in the range of the angular inclination ($\alpha$) of a typical pump displacement it does not change significantly with the angle ($\alpha$).

Referring to the example shown on FIG. 4, the arcuate bearing surface 1*a* has an eccentricity of the type −Y, then the moment $M_{Fa}$ from the corresponding thrust pistons 44 on this side will decrease the resultant moment Mr in pump mode and increase the resultant moment Mr in braking or motor mode. For the arcuate bearing surface 1*b* with an eccentricity of the type +Y the moment $M_{Fb}$ from the thrust pistons 44 of this other side will increase the resultant moment Mr in pump mode and decrease it in braking or motor mode.

In order to determine the influence of the eccentricity Y it is necessary to consider together the direction of tilting of the swash plate 4, the direction of rotation of the shaft 2 and the related presence of a pressure load in the appropriate main pressure duct A, B. The effect of the eccentricity Y can be optimized by selection of their sign. By considering all theses parameters it can be found that the eccentricities of the right and left arcuate bearing surfaces 1*a*, 1*b* preferably have opposite signs to optimally compensate the moment Msw, which has opposite signs in pump and braking or motor modes. It is also due to the fact that the pressure in the second group of cylindrical recesses 43*a*, 43*b* is different because of their connection to the different pressure in the first pressure duct A and the second pressure duct B.

Both types of eccentricity can be combined for optimisation according to the application requirements. By the combination of the eccentricity X with the eccentricity Y, the force and the moment influences of both types of eccentricity will be super-positioned, because the moments are linear functions of forces. With an appropriate arrangement of the mounting of the swash plate 4 of the axial piston machine 10 with an appropriate choice of eccentricities X and Y, it is possible to significantly decrease the moments necessary for the control of the angular inclination (α) of the swash plate 4.

The following tables provides some examples of the moment and the force influences on the swash plate with the value of the balancing moments $M_F$ as a function of the eccentricities X and Y. The eccentricities +X or −X and +Y or −Y can be combined in all possible ways in order to optimise the pump displacement control behaviour according to application requirements.

The small values of the axial movement of the thrust pistons 44 towards the swash plate 4 are advantageous for the dimensioning of the swash plate 4, for built-in dimensions of the spring 45, for the guiding of the thrust piston 44 and for the sealing, which can be standard mass produced sealing 44*c*.

The arrangement of the axial piston machine 10 according to this invention can have applications on swash plate 4 type axial piston pumps with a variable displacement, in hydrostatic transmissions for mobile machinery and also for stationary applications.

Any type of control of the displacement of the machine such as manual, hydraulic or electro-hydraulic control can be used. Moreover it is possible to use a direct manual control allowing the control of the torque without the need of servo-valve and servo-cylinders. This becomes possible for higher values of the maximum displacement of the pump and for applications with higher working pressure compared to the prior art.

In traditional valve plates, notches are defined in the feeding and suction orifices in order to obtain a transition of pressure when a cylinder 31 is commutating and the choice of the shape of these notches corresponds to a compromise between the noise level and the pressure in the cylinders 31. As a result of the arrangement of the present invention, the tilting torque due to the pressure in the cylinders 31 acting on the swash plate 4 can be compensated by an optimized eccentricity of the right and left arcuate bearing surfaces 1*a*, 1*b* and consequently noise can be more easily reduced so that the design of the valve plate 47 is easier.

The invention claimed is:

1. A hydraulic machine comprising:

a housing;

a cylinder block located in the housing and having pistons slidably movable in piston cylinders;

TABLE 1

Pump working mode in one direction of shaft rotation

| Direction of swash plate inclination | High pressure main conduct | Eccentricity of arcuate bearing surface 1a | Eccentricity of arcuate bearing surface 1b | Direction of $M_{SW}$ | Direction of $M_F$ | Expression of $M_F$ (Absolute value) |
|---|---|---|---|---|---|---|
| +α | A | −X | −X | CW | CW | F*X*sinα |
| | | −Y | +Y | CW | CCW | $(F_a - F_b)$ *Y*cosα |
| −α | B | −X | −X | CCW | CCW | F*X*sinα |
| | | −Y | +Y | CCW | CW | $(F_b - F_a)$ *Y*cosα |

CW = clockwise CCW = counterclockwise

TABLE 2

Motor or brake working mode in the same direction of shaft rotation

| Direction of swash plate inclination | High pressure main conduct | Eccentricity of arcuate bearing surface 1a | Eccentricity of arcuate bearing surface 1b | Direction of $M_{SW}$ | Direction of $M_F$ | Expression of $M_F$ (Absolute value) |
|---|---|---|---|---|---|---|
| +α | B | −X | −X | CCW | CW | F*X*sinα |
| | | −Y | +Y | CCW | CW | $(F_b - F_a)$*Y*cosα |
| −α | A | −X | −X | CW | CCW | F*X*sinα |
| | | −Y | +Y | CW | CCW | $(F_a - F_b)$*Y*cosα |

The value of X and Y eccentricities of the arcuate bearing surfaces 1*a*, 1*b* are obtained by calculation. Their actual values are small and consequently the angular tilting of thrust pistons 44 is also small.

a shaft rotationally connected to the cylinder block;

a swash plate in load engagement with the pistons of the cylinder block, the swash plate being pivotally mounted in the housing such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein the pivotal mounting of the swash plate in the housing comprises two swinging bearings coaxial with said kinematic axis, wherein said machine comprises first and second groups of thrust pistons located in cylindrical recesses in the swash plate, said recesses of the thrust pistons of said first group being hydraulically connected to each other, wherein a pre-stressed spring is mounted in the cylindrical recess between each of the thrust pistons and the swash plate.

2. The hydraulic machine of claim 1, wherein said thrust piston is adapted to be in fluid communication with one of a first and second main duct of the hydraulic machine.

3. The hydraulic machine of claim 1, comprising at least a right thrust piston located on one side of a plane which is perpendicular to the kinematic axis and passes through the rotation axis of the cylinder block, and a left thrust piston located on another side of said plane.

4. The hydraulic machine of claim 1, wherein said machine is a pump.

5. A hydraulic machine comprising:

a housing;

a cylinder block located in the housing and having pistons slidably movable in piston cylinders;

a swash plate in load engagement with the pistons of the cylinder block, the swash plate being pivotally mounted in the housing by at least one bearing, such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein said thrust piston includes a spherical side surface contacting a cylindrical recess in which the thrust piston is seated.

6. The hydraulic machine of claim 5, wherein said thrust piston is provided with a sealing ring in said side surface.

7. A hydraulic machine comprising:

a housing;

a cylinder block located in housing and having pistons slidably movable in piston cylinders;

a shaft rotationally connected to the cylinder block;

a swash plate in load engagement with the pistons of the cylinder block, the swash plate being pivotally mounted in the housing by at least one bearing, such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein said machine comprises first and second groups of thrust pistons located in cylindrical recesses in the swash plate, said recesses of the thrust pistons of said first group being hydraulically connected to each other, the pistons of said first group having a first diameter, and the pistons of the second group having a second diameter, said second diameter being larger than said first diameter.

8. The hydraulic machine of claim 7, wherein a first cylindrical recess for a thrust piston of the second group of thrust pistons is located on one side of a plane perpendicular to the kinematic axis and passing through the rotation axis, and said cylindrical recess is adapted to be connected to a first main duct of the machine, and a second cylindrical recess for a thrust piston of the second group and located on the other side of said plane is adapted to be connected to a second main duct of the machine.

9. The hydraulic machine of claim 7, wherein said first group of thrust pistons comprises four thrust pistons, each having a first diameter.

10. The hydraulic machine of claim 9, wherein the second group of thrust pistons comprises two thrust pistons having a second diameter, said second diameter being larger than said first diameter.

11. A hydraulic machine comprising:

a housing;

a cylinder block located in the housing and having pistons slidably movable in piston cylinders;

a shaft rotationally connected to the cylinder block;

a swash plate in load engagement with the pistons of the cylinder block, the swash plate being pivotally mounted in the housing by at least one bearing, such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein said machine comprises first and second groups of thrust pistons located in cylindrical recesses in the swash plate, said recesses of the thrust pistons of said first group being hydraulically connected to each other, wherein said housing first and second arcuate surfaces formed respectively on first arid second sides of a plane perpendicular to the kinematic axis and passing through the rotation axis, said first group comprising pistons that are located on either sides of said plane so as to engage said first and second bearing surfaces, and said second group comprising a first thrust piston which is located in a first cylindrical recess, located on one side of said plane and adapted to be connected to a first main duct of machine and a second thrust piston which is located in a second cylindrical recess, located on the other side of said plane and adapted to be connected to a second main duct of the machine, said first and second thrust pistons of the second group respectively, engaging said first and second arcuate surfaces.

12. The hydraulic machine of claim 11, wherein said first cylindrical recess is connected to said first main duct via a first piston cylinder when said first piston cylinder is in communication with said first main duct, and said second cylindrical recess is connected to said second main duct via a second piston cylinder when said second piston cylinder is in communication with said second main duct.

13. The hydraulic machine of claim 11, wherein the cylindrical recesses for the first group of thrust pistons are hydraulically connected by a valve device to one of two main ducts of the machine, which is at the higher pressure.

14. A hydraulic machine comprising:

a housing;

a cylinder block located in the housing and having pistons slidably movable in piston cylinders;

a shaft rotationally connected to the cylinder block, the swash plate being pivotally mounted in the housing by at least one bearing, such that said swash plate is pivotally adjustable about a kinematic axis to alter a hydraulic displacement of the pistons in the cylinder block, and;

trust pistons located between the swash plate and the housing so as to urge the swash plate toward the cylinder block, wherein said housing has first and second arcuate surfaces formed thereon respectively located on first and second sides of a plane perpendicular to a kinematic axis and passing through the rotation axis, said first and second arcuate surfaces respectively cooperating with said right thrust pistons with said left thrust piston, wherein the first and second arcuate surfaces are eccentric with respect to said kinematic axis.

15. The hydraulic machine of claim 14, wherein the centres of said first and second arcuate surfaces are both located on a first side of a plane which is perpendicular to the shaft axis and passes through the kinematic axis.

16. The hydraulic machine of claim 14, wherein the centre of said first arcuate surface is located on a first side of a plane defined by the shaft axis and the kinematic axis, and the centre of said second arcuate surface is located on an opposing side of the same plane.

17. A hydraulic machine comprising:

a housing;

a cylinder block located in the housing and having pistons slidably movable in piston cylinders, a shaft rotationally connected to the cylinder block;

a swash plate in load engagement with the pistons of the cylinder block, the swash plate being pivotally mounted in the housing such that said swash plate is pivotally adjustable about a kinematic axis to alter a hydraulic displacement of the pistons in the cylinder block, wherein there is at least a right thrust piston located on one side of a plane which is perpendicular to the kinematic axis and passes through the rotation axis of the cylinder block, and a left thrust piston located on the other side of the plane;

wherein said housing has first and second arcuate surfaces formed thereon respectively located on first and second sides of said plane perpendicular to the kinematic axis and passing through the rotation axis;

said first and second arcuate surfaces respectively cooperating with said right thrust piston and with said left thrust piston, wherein the pivotal mounting of the swash plate in the housing comprises two swinging bearings coaxial with said kinematic axis, wherein said thrust pistons are abutted against the first and second arcuate surfaces by a partly cylindrical bearing surface formed in each thrust piston.

18. The hydraulic machine of claim 17, wherein the centres of said first and second arcuate surfaces are coaxial with said kinematic axis.

19. The hydraulic machine of claim 18, wherein the first and second arcuate surfaces are eccentric with respect to said kinematic axis.

20. A hydraulic machine comprising:

a housing;

a cylinder block located in the housing and having pistons slidably movable in piston cylinders;

a shaft rotationally connected to the cylinder block;

a swash plate in load engagement with the pistons of the cylinder block, the swash plate being pivotally mounted in the housing, such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein the pivotal mounting of the swash plate in the housing comprises two swinging bearings coaxial with said kinematic axis, wherein a pre-stressed spring is mounted in the cylindrical recess between each of the thrust pistons and the swash plate.

21. The hydraulic machine of claim 20, wherein said swinging bearings are spherical bearings.

22. A hydraulic machine comprising:

a housing;

a cylinder block located in the housing and having pistons slidably movable in piston cylinders;

a shaft rotationally connected to the cylinder block;

a swash plate in load engagement with the pistons of the cylinder block, the swash plate being pivotally mounted in the housing, such that said swash plate is pivotally adjustable about a kinematic axis to alter a hydraulic displacement of the pistons in the cylinder block, and;

thrust pistons located between the swash plate and the housing so as to urge the swash plate toward the cylinder block, wherein the pivotal mounting of the swash plate in the housing comprises two swinging bearings coaxial with said kinematic axis, wherein a fluid communication between thrust pistons and a piston cylinder is permitted by a pressure channel formed inside the swash plate and an aperture formed in the piston cylinder and a conduit formed in a piston rod located between the cylinder and the swash plate.

* * * * *